US006123578A

United States Patent [19]

Truett

[11] Patent Number: 6,123,578

[45] Date of Patent: Sep. 26, 2000

[54] COMBINATION ELECTRICAL/ MECHANICAL MOUNTING CONNECTOR

[76] Inventor: Brett B. Truett, P.O. Box 5039, Utica, N.Y. 13505-5039

[21] Appl. No.: 09/092,145

[22] Filed: Jun. 5, 1998

[51] Int. Cl.[7] ..... H01R 13/73

[52] U.S. Cl. ..... 439/551; 439/550

[58] Field of Search ..... 439/550, 551

[56] References Cited

U.S. PATENT DOCUMENTS

| | | | |
|---|---|---|---|
| 1,031,337 | 7/1912 | Hartman . | |
| 2,737,543 | 3/1956 | Irwin et al. . | |
| 2,843,831 | 7/1958 | Pliskin . | |
| 2,949,642 | 8/1960 | Lieberman . | |
| 3,059,205 | 10/1962 | Sturdivant . | |
| 3,673,544 | 6/1972 | Dupree . | |
| 3,860,315 | 1/1975 | Tetreault et al. . | |
| 4,077,690 | 3/1978 | Koether . | |
| 4,138,183 | 2/1979 | Soos . | |
| 4,516,425 | 5/1985 | Chollet et al. . | |
| 4,591,216 | 5/1986 | McClune | 439/551 |
| 4,624,472 | 11/1986 | Stuart et al. | 439/34 |
| 4,722,695 | 2/1988 | Zwicker . | |
| 4,823,602 | 4/1989 | Christensen . | |
| 4,825,710 | 5/1989 | Koneval et al. . | |
| 4,880,519 | 11/1989 | Wang et al. . | |
| 4,900,260 | 2/1990 | Drogo . | |
| 5,121,110 | 6/1992 | Mahar, Jr. et al. | 340/693 |
| 5,413,502 | 5/1995 | Wang | 439/551 |
| 5,924,893 | 7/1999 | Eidsvig | 439/551 |

*Primary Examiner*—Paula Bradley
*Assistant Examiner*—Katrina Davis
*Attorney, Agent, or Firm*—Robert O. Wright

[57] ABSTRACT

A mounting for precisely positioning a sensor on an apparatus while allowing removal and replacement without disturbing the precise positioning is shown. A single combination mechanical/electrical connector is used to fix a sensor in its mounting.

17 Claims, 5 Drawing Sheets

COMBINATION ELECTRICAL/ MECHANICAL MOUNTING CONNECTOR

This invention relates to the electrical connection and mechanical mounting of manipulating devices on mechanisms. More particularly it relates to a method and apparatus for removably mounting a sensor on a machine in a precise operating position with a single combination electrical/ mechanical connector that allows repeated removal and replacement without affecting its precise operating position.

BACKGROUND OF INVENTION

Modern apparatus of all types increasingly require sensors to be incorporated therein to permit proper manipulation control and operation of the apparatus. Historically this has meant the mechanical positioning of the desired manipulation device in the appropriate position on the apparatus and the electrical connection of the device to the apparatus controller. Apparatus of this type frequently involve movable parts and/or work pieces which sometimes impact the manipulation device sensor destroying its functionality. This has led to the need to quickly remove and replace sensors without requiring costly and time consuming recalibration.

OBJECTS AND SUMMARY OF INVENTION

Accordingly it is an object of the present invention to provide a method and apparatus for mounting manipulating devices in precise positions on machines so they can be quickly and easily changed out without upsetting the precise positioning thereof.

It is another object of the present invention to provide a single connector for mechanically positioning and electrically connecting a control device in a precise position on a machine.

It is another object of the present invention to provide a quick change out capability for control devices mounted in precise positions on a machine.

It is further object of the present invention to provide a housing for soft mounting a sensor on a machine in a precise position utilizing a single mechanical/electrical connector.

It is a still further object of the present invention to provide a unique mounting interface for precisely positioning a removable control device on an apparatus while maintaining a quick change out capability.

These and other and further objects of the invention are accomplished in one embodiment in which a tubular sensor is inserted in a tube, soft mounted in a precise position on a machine, and mechanically and electrically secured in proper position in said tube by a single combination cordset connector.

BRIEF DESCRIPTION OF THE DRAWINGS

The invention will become better understood from the following description taken in conjunction with the drawings in which.

DETAILED DESCRIPTION OF A PREFERRED EMBODIMENT

Figure 1:
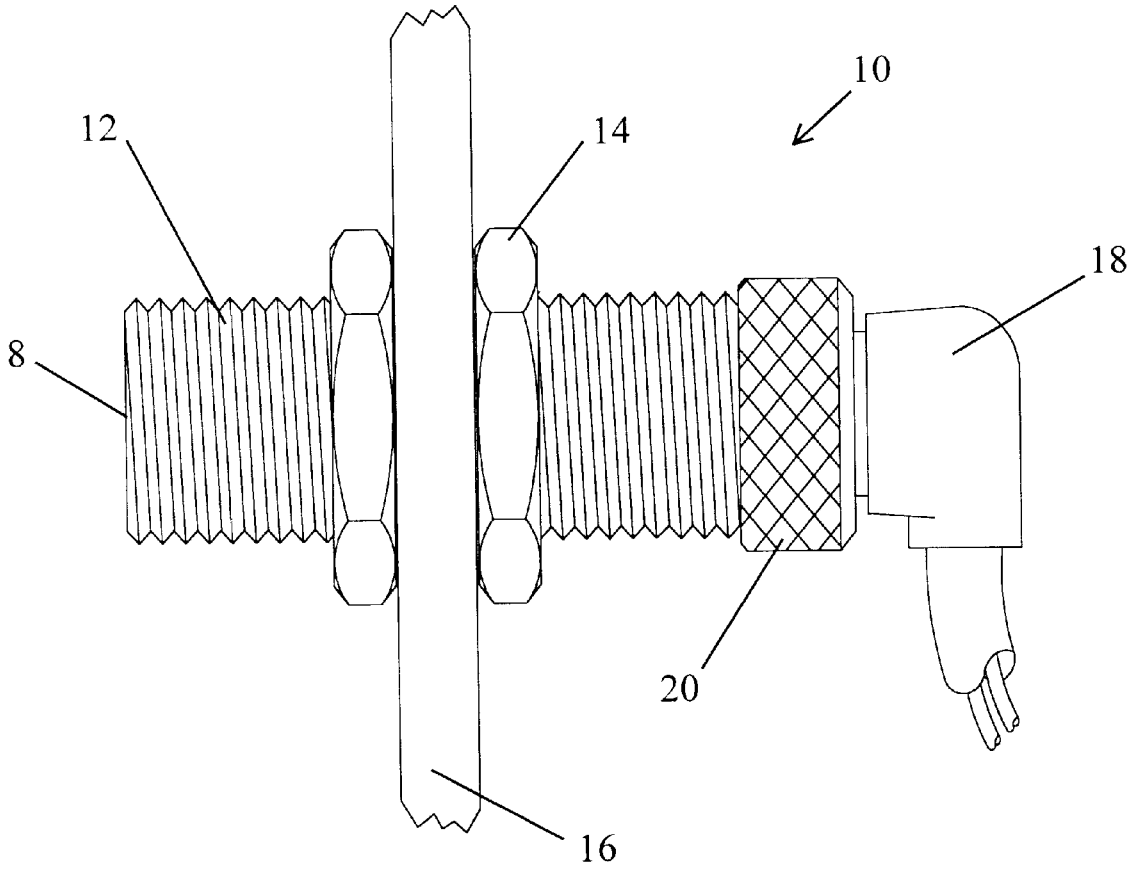
Prior Art Fig. 1
FIG. 1 is a side elevational view of a typical prior art device.

FIG. 1 shows a typical prior art device in which a tubular sensor 10 has a threaded exterior surface 12. The tubular sensor 10 is mounted on a machine by a pair of jamb nuts 14, one on either side of wall 16. A standard right angle connector cord set 18 fits on the terminal end of sensor 10 and is secured theron by a threaded nut 20. If the sensor 10 fails or is damaged, to replace it, not only must the connector 18 be removed by loosening nut 20, but the nuts 14 must be removed to replace sensor 10 with a new one. The new sensor must then be repositioned and calibrated by adjusting nuts 14 until the sensor face 8 is located at the correct position for accurate sensing.

Figure 2:
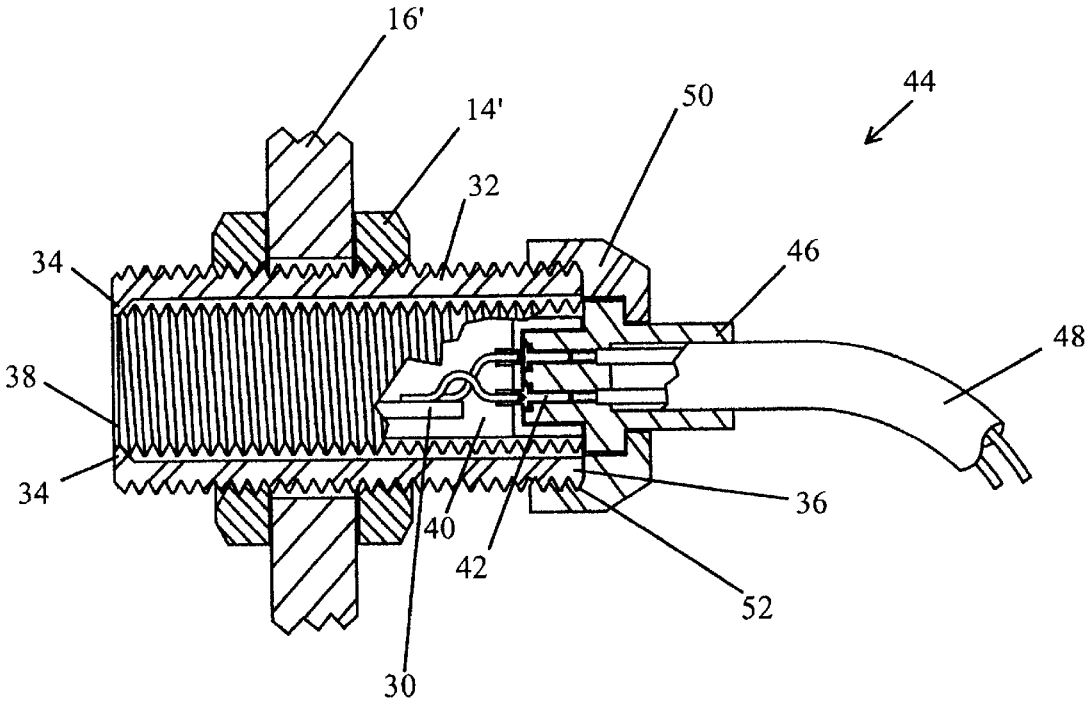
FIG. 2 is cross sectional view of tubular sensor mounted according to the present invention.

Referring now to FIG. 2 a tubular sensor 30 according to, the present invention is provided with a housing 32 which has a retaining shoulder or lip 34 at one end and a threaded portion 36 at the other. The threads of threaded portion 36 may be extended the full length of housing 32 if desired. The proximity sensing face 38 of sensor 30 is inserted into housing 32 until it abuts lip 34. The other end 40 of sensor 30 has two or more male connector pins 42 which form the electrical connection to the sensing face 38.

Combination connector 44 has an electrical female connector member 46 adapted to receive the male connector pins 42 of sensor 30 completing the electrical connection to cordset 48. A collar 50 is rotatably mounted about connector member 46 and has threads 52 formed on the inside surface sized to mate with the threads 36 on housing 32. The size and length of member 46 is chosen so as to not only receive the connector pins 42 of sensor 30 but to also act as a cam to secure sensor 30 firmly in housing 32 when collar 50 is tightened onto the threaded end 36 of housing 32.

Unlike the prior art if sensor 30 fails it may be quickly and easily replaced by unscrewing collar 50, disconnecting connector 46, removing sensor 30 and replacing it with a new one, and reinstalling combination connector 44 by tightening collar 50. No repositioning and recalibration is necessary since the new sensor 30 will be positioned against lip 34 in the exact same position as the original sensor 30.

Figure 3:
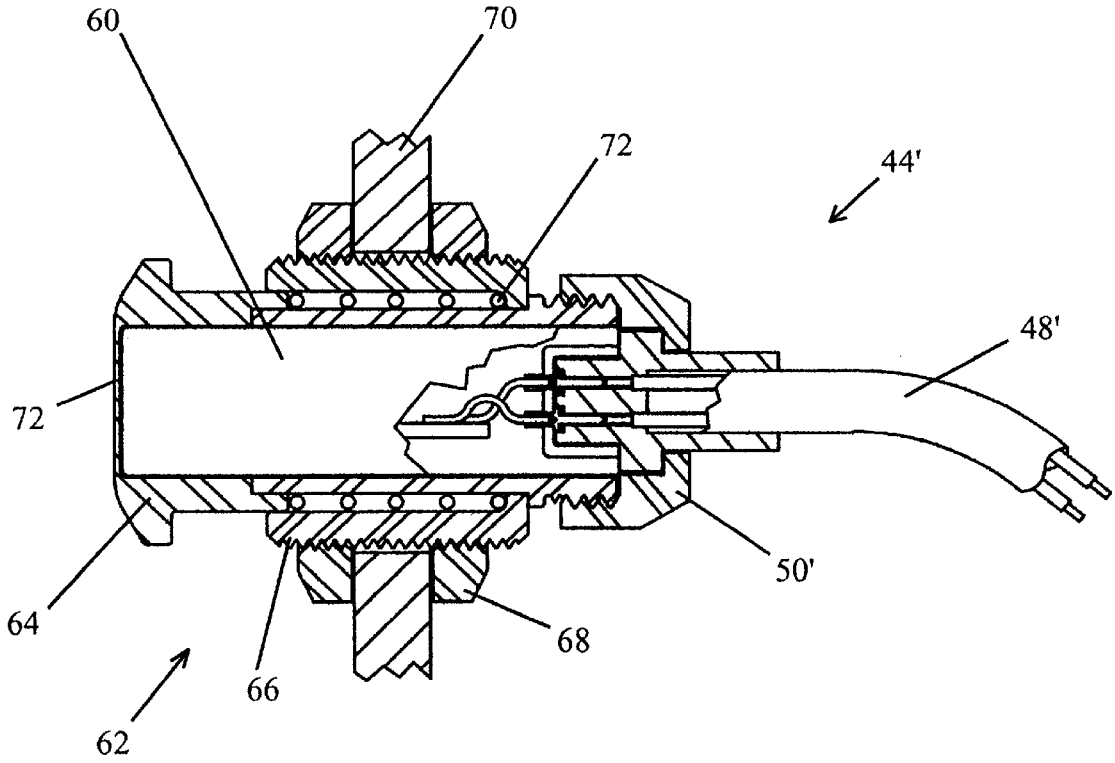
FIG. 3 is a cross sectional view of another embodiment of the present invention.

Referring now to FIG. 3 there is shown an embodiment in which a sensor 60 is completely enclosed in a protective two piece housing 62 which includes an inner sleeve 64, and a threaded outer body portion 66 slidably spring mounted about sleeve 64 to form a soft mounting device according to my U.S. Pat. No. 5,121,110. Sleeve 64 is biased by spring 72 to extend outwardly from outer body portion 66 which is threaded and carries thereon jamb nuts 68. Nuts 68 fix the assembly in machine wall 70 to precisely position the sensing head to properly perform its function on the machine in which it is installed. The end of sleeve 64 is closed by a thin wall 73, which together with its spring mounting, provides complete protection from accidental impact either directly on the end face of the sensor or from impact on the end of sleeve 64. Thus with this embodiment low cost plastic encapsulated sensors can be used instead of the more expensive metallic enclosed sensors shown in FIGS. 1 and 2. Also sensor 60 not only can be a cheap plastic sensor it can be quickly and easily replaced by unscrewing collar 50' and disconnecting cordset 48' as described in the FIG. 2 embodiment.

Figure 4:
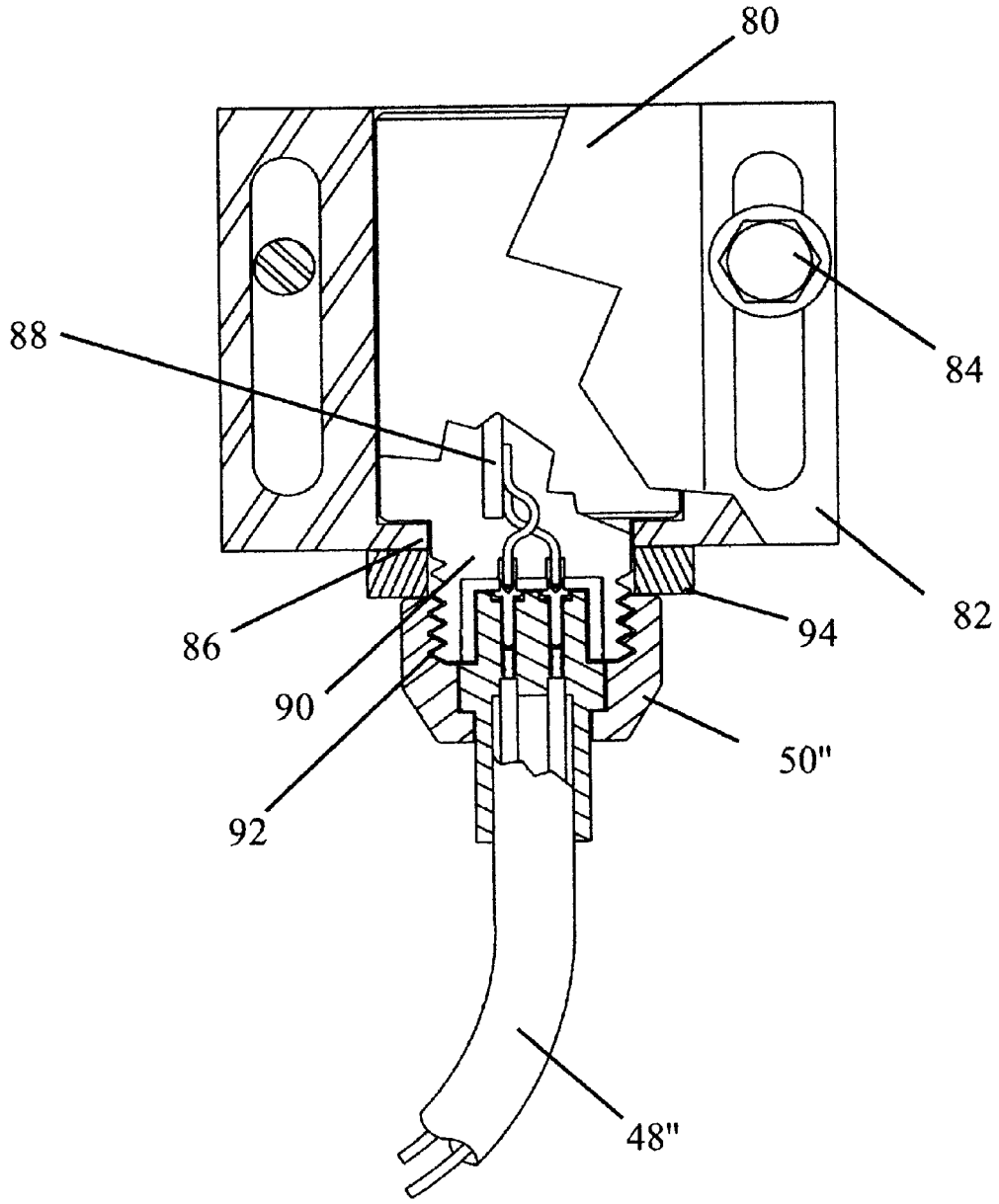
FIG. 4 is a partially broken away cross sectional view of a further embodiment of the present invention.

While I have described the present invention applied to a tubular sensor it may be applied to any of the many forms of sensors, limit switches, and other devices. Referring now to FIG. 4 there is shown another embodiment of the present invention in which a rectangular cross section housing 80 is bolted through flanges 82 by bolts 84 to a machine. Housing 80 may be open on the left of FIG. 4 and have a small hole 86 on the back or right hand wall. A rectangular or round sensor 88 has a cylindrical stud 90 sized to fit through hole 86 which is threaded about its outer surface at 92. Cordset 48" with collar 50" will then position and secure sensor 88 in its proper position within housing 80. A suitable compressable washer 94 may be used if required. Housing 80 once positioned on a machine does not have to be moved to replace the sensor 88 as described above in connection with FIGS. 2 and 3.

Figure 5:
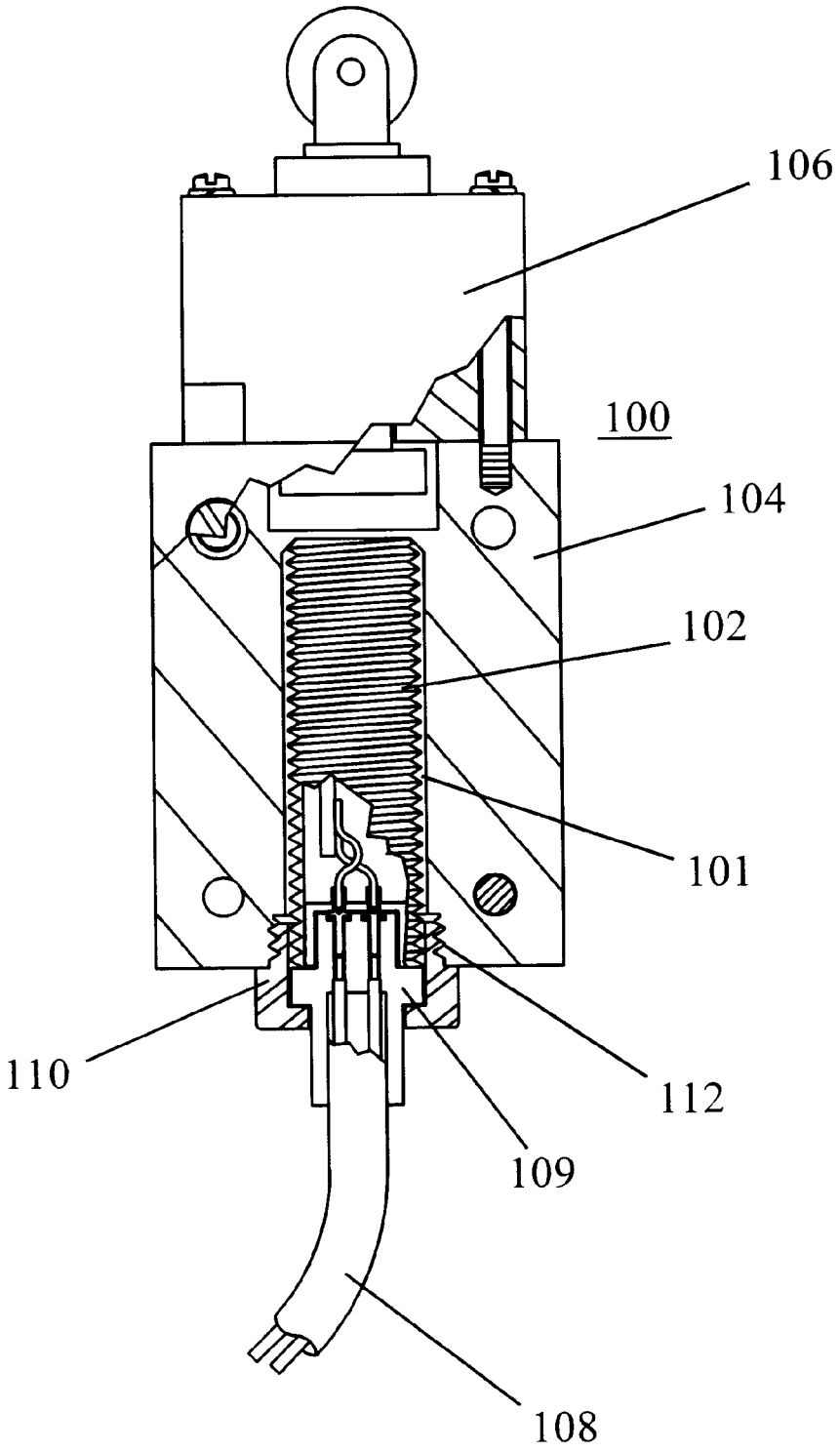
FIG. 5 is a partially broken away cross sectional view of a still further embodiment of the invention.

FIG. 5 shows the old familiar industrial limit switch 100 in which the mechanical switch contacts have been replace by a proximity sensor 102 in accordance with the present invention. Sensor 102 is positioned in a cylindrical recess within body 104 which has operator head 106 mounted thereon. Sensor 102 is held in proper position within body 104 by the combination connector of cordset 108 which includes electrical female connector member 109 and collar 110. Collar 110 is threaded on the outer surface at 112 to engage in internal threads formed at the entrance to recess 101. Again electrical and physical positioning of the sensor 102 is accomplished with a single combination connector allowing fast and simple replacement without recalibration.

While there are given above certain specific examples of this invention and its application in practical use, it should be understood that they are not intended to be exhaustive or to be limiting of the invention. On the contrary, these illustrations and explanations herein are given in order to acquaint others skilled in the art with this invention and the principles thereof and a suitable manner of its application in practical use, so that others skilled in the art may be enabled to modify the invention and to adapt and apply it in numerous forms each as may be best suited to the requirement of a particular use.

What is claimed is:

1. Means for mounting manipulating devices, having both mechanical positioning and electrical connection portions, in operative position on an apparatus while permitting fast and easy servicing, removal and replacement without invalidating a previous precise positioning thereof which comprises:

an outer enclosure adapted to receive and position a manipulating device having an operating end and an electrical connection end in a precise position therein;

mounting means fixing said outer enclosure in a precise position on an apparatus;

said outer enclosure having fixed internal locating means precisely positioning the operating end of a manipulating device in said outer enclosure;

said outer enclosure having means adjacent the electrical end of the manipulating device positioned in said outer enclosure, to cooperatively mechanically position and secure the manipulating device therein when a single connector means, having an electrical contact portion mating with an electrical connection portion of the manipulating device and a mechanical contact portion to operatively engage with said means to cooperatively mechanically position and secure the manipulating device in said outer enclosure, is connected thereto;

whereby when said outer enclosure is fixed in position the manipulating device may be installed mechanically and connected electrically in a precise operative position on an apparatus and then removed and replaced in the precise same position by operation of a single connector.

2. The invention as claimed in claim 1 wherein said outer enclosure comprises a limit switch, having an operating end and a connecting end, mounted on the apparatus;

said connecting end including said means to cooperatively mechanically position and secure the manipulating device in said outer enclosure and electrical contact means to mate with said single connector electrical contact portion.

3. The invention as claimed in claim 1 wherein said outer enclosure comprises a protective housing having a single aperture for inserting a control device therethrough and for mechanically and electrically securing it in said housing; and said housing has a thin window wall generally opposite said aperture and adjacent the operating end of said control device to permit actuation thereof from outside said protective housing while preventing direct contact therewith.

4. The invention as claimed in claim 1 wherein said outer enclosure is an elongated tube having a threaded central portion and a pair of cooperating jamb nuts for mounting said outer enclosure in an apparatus aperture; and said elongated tube has manipulating device positioning means at one end and a threaded portion at the opposite end outer surface for mating with said single connector mechanical contact portion.

5. The invention as claimed in claim 2 further including:

a threaded outer cylindrical sleeve disposed about said elongated tube;

said pair of cooperating jamb nuts are positioned on said outer sleeve; and a helical cylindrical spring is mounted about said elongated tube within said outer sleeve and operatively connected thereto to bias said elongated tube axially outwardly from said outer sleeve;

whereby said outer enclosure is resiliently retractable within said outer sleeve so as to form a soft mounting of said manipulating device in the apparatus.

6. A control device assembly for precision mounting of control devices, requiring both mechanical positioning and electrical connection, in a precise operative position on an apparatus while permitting fast and easy servicing, removal and replacement without invalidating a previous precise positioning thereof which comprises in combination:

an outer enclosure adapted to receive and position a control device in a precise position therein;

mounting means fixing said outer enclosure in a precise position on the apparatus;

a control device positioned in said outer enclosure;

said control device having an operating end and an electrical contact end spaced apart from said operating end;

said outer enclosure having therein means precisely positioning said operating end of said control device in said outer enclosure;

said outer enclosure having means adjacent said control device electrical contact end cooperatively securing said control device in said precise position in said outer enclosure;

a single connector means having an electrical contact portion mating with said electrical contact end of said control device and a mechanical contact portion operatively engaging said means cooperatively securing said control device in said outer enclosure;

whereby when said assembly is fixed on the apparatus in a precise position said control device may be removed mechanically and electrically from said position on the apparatus and then replaced in the precise same position by operation of said single connector means.

7. The invention as claimed in claim 6 wherein said single connector means includes a female electrical socket member and a female threaded nut member rotatably mounted about said socket member;

said socket member mating with said control device electrical contact end; and said nut member mating with said outer enclosure means securing said control device in said outer enclosure.

8. The invention as claimed in claim 6 wherein said mounting means for fixing said outer enclosure on an apparatus comprises a plurality of bolts extending through said outer enclosure into the apparatus on which it is mounted.

9. The invention as claimed in claim 6 wherein said said outer enclosure comprises a limit switch, mounted on an apparatus, and having an operating end and a connecting end;

said connecting end including said means for cooperatively securing said control in said enclosure and electrical contact means for mating with said connector electrical contact portion.

10. The invention as claimed in claim 6 wherein said outer enclosure comprises a protective housing having a single aperture for inserting a control device therethrough and for mechanically and electrically securing it in said housing; and said housing has a thin window wall generally opposite said aperture and adjacent the operating end of said control device to permit actuation thereof from outside said protective housing while preventing direct contact therewith.

11. The invention as claimed in claim 6 wherein said control device is a proximity sensor having a sensing head at one end and an electrical contact means at the other end;

said outer enclosure is an elongated tube having a threaded central portion and a pair of cooperating jamb nuts for mounting said outer enclosure in an apparatus apperture; and said elongated tube has sensor positioning means at one end and a threaded portion at the opposite end outer surface for mating with said single connector mechanical contact portion.

12. The invention as claimed in claim 11 wherein said threaded central portion of said outer enclosure includes a threaded outer cylindrical sleeve disposed about said elongated tube and said pair of jamb nuts are positioned on said outer sleeve; and a helical cylindrical spring mounted about said elongated tube within said outer sleeve and operatively connected thereto to bias said elongated tube axially outwardly from said outer sleeve;

whereby said outer enclosure is resiliently retractable within said outer sleeve so as to form a soft mounting of said sensor in an apparatus.

13. A protective housing and mounting for non-metallic encapsulated sensors adapted to electrically connect and mechanically position a non-metallic sensor on an apparatus for fast and easy servicing, removal and replacement which comprises:

a metallic outer enclosure;

mounting means operatively connected to said outer enclosure to fix said outer enclosure in a precise position on the apparatus;

said outer enclosure having a cavity for receiving and precisely positioning therein the non-metallic sensor;

said cavity having a sensor locating end and a sensor electrical contact end spaced apart from said locating end;

means adjacent said electrical contact end of said cavity for cooperatively mechanically securing the non-metallic encapsulated sensor within said outer enclosure cavity;

single connector means having an electrical connector portion configured to mate with an electrical connection portion of the non-metallic sensor; and said single connector means having a mechanical contact portion configured to operatively engage said means for cooperatively mechanically securing the non-metallic sensor in said outer enclosure cavity;

whereby when said outer enclosure is fixed in position the non-metallic sensor may be repeatedly installed mechanically and connected electrically in a precise operative position protected from damage by said outer enclosure.

14. The invention as claimed in claim 13 wherein said outer enclosure comprises a limit switch, having a body portion with an operating end and a connecting end;

said body connecting end including said means cooperatively securing the non-metallic sensor in said outer enclosure when said single connector means is connected to the electrical connecting portion of the non-metallic sensor.

15. The invention as claimed in claim 13 wherein said outer enclosure comprises a protective housing having a single aperture for inserting a control device therethrough and for mechanically and electrically securing it in said housing; and said housing has a thin window wall generally opposite said aperture and adjacent the operating end of said control device to permit actuation thereof from outside said protective housing while preventing direct contact therewith.

16. The invention as claimed in claim 13 wherein said outer enclosure comprises:

a cylinder having a threaded exterior surface carrying a pair of jamb nuts for mounting said cylinder in an aperture of an apparatus;

shoulder means at one end of said cylinder for precisely positioning the non-metallic sensor therein; and said cylinder threaded exterior having a diameter sized to mate with the threaded collar of a cordset adapted to electrically connect with the non-metallic sensor.

17. The invention as claimed in claim 16 further including a second threaded outer cylindrical sleeve disposed about said cylinder and said pair of jamb nuts are positioned on said outer sleeve; and a helical cylindrical spring mounted about said cylinder within said second sleeve and operatively connected thereto to bias said cylinder axially outwardly from said sleeve;

whereby said outer enclosure is resiliently retractable within said outer cylindrical sleeve so as to form a soft mounting of said sensor in an apparatus.

* * * * *